US009844247B2

(12) United States Patent
Kelly

(10) Patent No.: US 9,844,247 B2
(45) Date of Patent: Dec. 19, 2017

(54) VERTICALLY ADJUSTABLE CHARM SYSTEM

(71) Applicant: Katrina Kelly, West Hollywood, CA (US)

(72) Inventor: Katrina Kelly, West Hollywood, CA (US)

( * ) Notice: Subject to any disclaimer, the term of this patent is extended or adjusted under 35 U.S.C. 154(b) by 0 days.

(21) Appl. No.: 13/968,821

(22) Filed: Aug. 16, 2013

(65) Prior Publication Data

US 2015/0047392 A1 Feb. 19, 2015

(51) Int. Cl.

| | |
|---|---|
| ***A44C 13/00*** | (2006.01) |
| ***A44C 5/20*** | (2006.01) |
| ***A44C 15/00*** | (2006.01) |
| ***A44C 25/00*** | (2006.01) |

(52) U.S. Cl.

CPC ..... *A44C 5/2038* (2013.01); *A44C 15/005* (2013.01); *A44C 25/001* (2013.01)

(58) Field of Classification Search

CPC ..... A44C 13/00; A44C 25/00; A44C 25/001; A44C 25/007; A44C 5/2038; A44C 15/005; A44C 9/0038; A44C 27/00; A44B 15/00; A44B 15/002; G01B 3/34; G01B 3/14; G01B 5/213; F16B 45/02

USPC ..... 24/3.6, 3.11, 3.12, 574.1; 206/37.8; 63/33, 40, 21, 23, 1.16; 30/324; D10/46.2, 46.3; D11/79, 8

See application file for complete search history.

(56) References Cited

U.S. PATENT DOCUMENTS 4,083,212 A * 4/1978 Proefrock ..... E05B 17/0062 70/366
5,842,365 A * 12/1998 Bordonaro ..... A44B 15/00 206/37.1

FOREIGN PATENT DOCUMENTS

DE 029120210 U1 * 4/1996 ..... A44B 15/00
FR EP 1767113 A1 * 3/2007 ..... A44C 9/0023

* cited by examiner

*Primary Examiner* — Jack W Lavinder
(74) *Attorney, Agent, or Firm* — Wilson Legal Group P.C.; John Wilson; Ryan Prugh

(57) ABSTRACT

A vertically interchangeable and stackable jewelry system which includes a pendant bail clasp and stackable pendants. The bail clasp opens with a hinged lever, which includes a beveled edge opposite the hinged end of the lever. In addition, the clasp contains a complementary beveled edge which locks with the beveled edge of the hinged lever to lock the pendant bail clasp. Each pendant includes a uniform hooking mechanism at an exterior edge to connect pendant to the bail clasp. Differing pendants all have the same hooking mechanism to facilitate proper stacking. Pendants are available in a variety of shapes, colors, and sizes such an infinite number of combinations are available. The front and back surface of each charm is curved to facilitate vertical stacking of the charms upon and beneath each other. The present jewelry system also includes an interior view when ornaments have center openings and are vertically stacked.

10 Claims, 6 Drawing Sheets

VERTICALLY ADJUSTABLE CHARM SYSTEM

CROSS-REF. TO RELATED APPLICATIONS

None.

TECHNICAL FIELD

This invention relates to jewelry, and more specifically to a system and method for adjusting the appearance of jewelry with vertically interchangeable and stackable pendants.

BACKGROUND

People, both men and women, often wear jewelry to enhance their appearance or complement their clothing and other accessories. The look one desires to achieve may influence a person regarding the color, shape or size of their jewelry. In order to achieve a unique look, a wearer may decide to layer separate pieces but this will require the user to purchase multiple pieces of jewelry. Purchasing jewelry to match several outfits could potentially become very expensive and beyond the budget of many jewelry wearers. In addition, layering multiple pieces of jewelry also presents the risk of multiple chains becoming tangled around the wrist or neck of the user. Tangled chains are likely more difficult to remove once the user decides to remove the jewelry. In addition, the user will have to position the pendants on the multiple chains in such a manner that each ornament is visible and not hidden beneath another pendant on a neighboring chain. In addition, the layered ornaments may not flatter each other to create an aesthetically pleasing image.

Charms are differing ornaments, pendants, or trinkets that may be attached to a single bracelet or necklace. The user may change the appearance of the bracelet or necklace by attaching a variety of colors or shapes to the bracelet or necklace. However, charms or ornaments are typically suspended from the bracelet or necklace laterally or horizontally in such a way that each ornament hangs alongside the other ornaments in a row. This type of lateral hanging prevents any type of methodical interconnection between the ornaments. The traditional charm bracelet or necklace is two-dimensional, non-versatile, and not interconnected with the other ornaments on the bracelet or necklace.

Charms or pendants on a typical necklace are not removable. Should the user decide to remove those charms, the user would need to consult with a professional jeweler to either disassemble or saw the charms from the jewelry. In order to reclose the jewelry, the piece would be reconnected by soldering or gluing the connection point closed. For the jewelry pieces designed with removable charms or pendants, those charms do not interconnect or interact with adjacent charms. Typically, the removable charms are separated along the chain upon which they hang. Currently available charms are not uniform in style or connection means such that any stacking would result in charms flipping backward or flopping over sideways. In addition, traditional charms are too bulky for laying and stacking in a cohesive, interconnected manner.

SUMMARY OF THE INVENTION

The present system and method involves pendants that can be vertically stacked and adjusted to alter the aesthetics of a jewelry piece. Due to the method of display, the individual pendants in the present system are methodically interconnected. The present disclosure presents various shapes, colors, and sizes of pendants which can be vertically stacked and displayed on a bail clasp displaying a wide ranging variety of looks. In addition, the pendants may be made from a variety of sturdy materials such as metals, alloys, resins, woods, bamboo, plastics, as well as other similar materials. With each unique variation of stacked and layered shapes, a new design and look creates an infinite number of new looks and creations for the user. The present jewelry system provide a unique personal experience that is not only interactive and engaging but also allows the user to become the designer and express individual originality and creativity. The user may constantly update and create infinite different looks and jewelry creations. The wearer may be rewarded and engaged as he or she participates in the design process. New pendants may continuously be added or removed to document life's milestones and special moments without purchasing an entirely new jewelry piece.

The present system is a kinetic mix and match of elements that promote a vertical silhouette and arrangement, which differs significantly from the existing charm system involving horizontal silhouette design arrangement. The pendants in the present system essentially pile or stack atop and under each other. The present pendants also interconnect and overlap within one another with the group of chosen pendants connected on a pendant bail clasp. The present system creates an infinite number of new vertically three dimensional designs and arrangements depending on which pendants are chosen by the user for any particular occasion. The appearance may be varied in color, number of charms, sizes, materials, shapes and positioning of different looking charms in the bail clasp.

The present system consists of at least two components. The first component being a pendant bail clasp on which the pendants are attached through the bail clasp. Once the pendants are arranged, the pendant bail clasp is hung from a standard jewelry chain. The pendant bail clasp accommodates a varied number of pendants; however, the size of the pendant bail clasp may be altered to accommodate additional pendants. The pendant bail clasp opens via a hinged and beveled latch which opens outward. The pendant clasp may also be a inward spring mechanism. In the present embodiment discussed herein, the pendant bail clasp may accommodate at least one and as many as eleven (11) pendants, however it is to be understood that the number of pendants may vary considerably depending on a specific embodiment of the present system. The second component of the present system is the pendant or charm available in differing shapes, sizes, and colors. Each pendant contains a top bail opening and an optional center opening. Each pendant may hang from the pendant bail at the top bail opening and interconnect with any other pendant in the system. The pendants or charms may be a variety of shapes, constructed from varied materials, and chosen from a number of sizes. In any case, all of the pendants and charms of the present disclosure are of the same thickness to ensure uniform stacking while hung from the pendant bail clasp. In use, a jewelry wearer would choose a combination of pendants to achieve a certain look. The user would then open the pendant bail clasp by unsnapping the hinged and beveled latch and sliding the desired pendants inside the pendant bail clasp. The user would then attach the bail clasp with attached pendants to a jewelry chain before hanging the adjustable jewelry system around the user's neck. The user also may decide to alter the appearance of the pendant bail clasp with attached pendants while wearing the adjustable jewelry system.

To further facilitate vertical stacking, each size and shape of the pendants has a uniform thickness, shape, and size. Additionally, the top bail opening, located at the top of the pendant to slide on the clasp, has uniform dimensions to increase the stability of stacked pendants. The pendants lay on top of and underneath one another when stacked on the pendant bail clasp. All pendants have a similar stylistic design for all sizes and shapes which embody similar top bail openings that are all cohesive. The top bail opening or jumping of each pendant slides onto the bail clasp uniformly allowing proper alignment so all pendants lay on and under one another. Although secured on the bail clasp, pendants may slide or swing to either side displaying a unique kinetic effect.

In addition, each pendant has a subtle, slightly smooth, and indented concave surface on the rear side and a smooth convex surface on the front side, such that any pendant can be the first, the last, or any member between. In addition, each pendant has a similarly shaped and sized top bail opening at the top edge of the pendant which fits on the pendant bail clasp. Each pendant has an interconnecting indented surface on the rear side and a smooth convex surface on the front side, such that multiple pendants interconnect when stacked vertically from the pendant bail clasp. The top bail jumping of each pendant has a curve that sits on the clasp in a manner that allows it to remain in position and be visually appealing. The proper alignment of the layering and stacking is achieved by the cohesive and uniform top bail opening or jumping as well as the uniform thickness of the pendants. Openings of varying thickness and size would be bulky and would protrude outwardly to the sides creating an unpleasant and undesirable aesthetic.

Whether there are two or several pendants inserted in the pendant bail clasp, the jewelry system will not appear bulky and the individual pendants will interconnect to the pendant immediately behind and immediately in front of each pendant. A user can mix pendants of gold, silver, platinum, palladium, alloy, plastics or a variety of other materials in order to change the appearance of the jewelry system. A user can also mix smaller, medium, or larger pendants to alter the aesthetics of the jewelry system. Additionally, the pendants are available in various shapes such as circular, oblong, square, rectangular, triangular, heart shaped, as well as a variety of other shapes such as star, animal, zodiac signs, numeric or alphabetic characters. Pendants or charms may also be accented with gemstones such as diamonds, sapphires, rubies, emeralds, cubic zirconium or a number of various decorative stones.

Without regard to the shape, size or color, an infinite variety of combinations of pendants may be stacked in the pendant bail clasp. This jewelry system creates a unique look when the jewelry is viewed from the side or the front. Each pendant is positioned such that the pendants immediately below and above are visible to the wearer and passersby. Each pendant has a uniform thickness in comparison to pendants of different sizes and shapes to ensure proper stacking and interconnectedness. Each pendant also has a uniform hook or top bail opening. In this embodiment, the pendants may be available in sizes such as extra-small, small, medium, large, and extra-large. Pendants may vary from 2 millimeters to 4 millimeters from one size to the next closest size. However, the top bail openings of the smallest pendants may differ slightly in size in order to facilitate insertion on the pendant bail clasp and ensure that the metal is not too thin and remains as durable as the other pendant sizes.

OBJECTS OF THE INVENTION

An object of the present invention is to provide a vertically interchangeable and stackable jewelry system.

Another object of the present invention is to provide a jewelry system in which shapes, color and amount of pendants may be adjusted and altered to create various looks for the user.

Another object of the present invention is to provide a jewelry system with pendants that complement each other regardless of the order of stacking said pendants.

Another object of the present invention is to provide a jewelry system which may be quickly adjusted to reflect occasions in the wearer's life or different style choices.

Another object of the present invention is to achieve a kinetic look from top and side views of a jewelry system.

Ref. 11 is the interconnection of a curved front surface of one pendant with a curved rear surface of an adjacent pendant; and Ref. 12 is the curved rear surface of a pendant.

Figure 6:
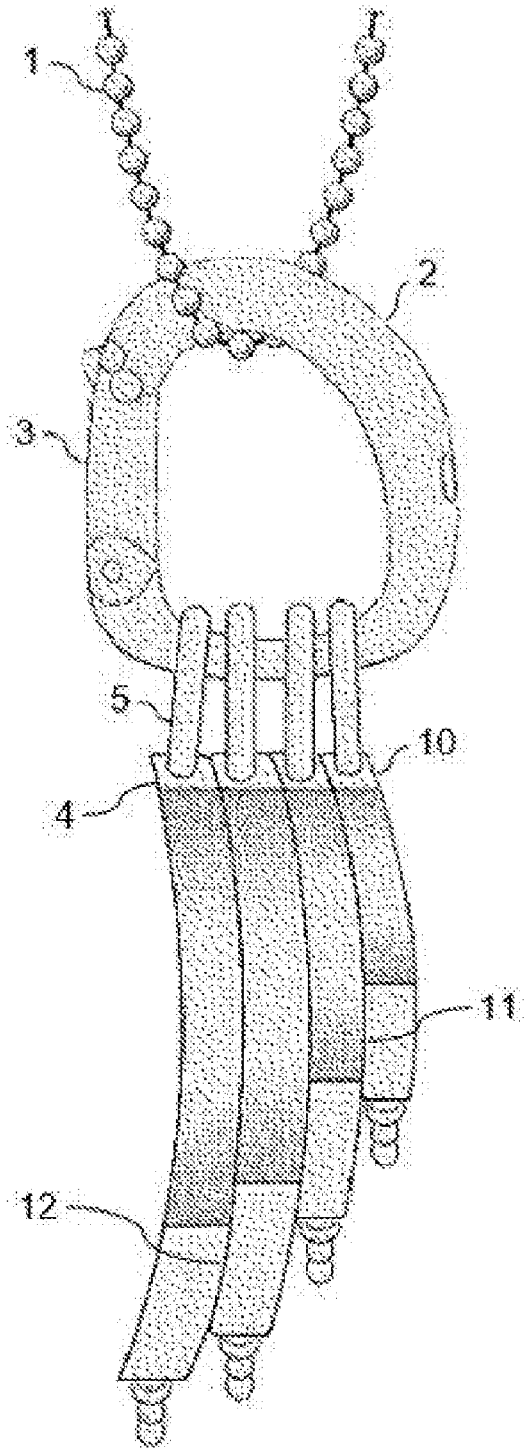

FIG. 6 is a cut cross-sectional, side view of an adjustable jewelry system embodying the principles of the present invention;

Ref. 1 is a chain;

Ref. 2 is the pendant bail clasp;

Ref. 3 is the pendant bail clasp latch;

Ref. 4 is a pendant;

Ref. 5 is a pendant top bail opening or jumping;

Ref. 10 is a curved front surface of a pendant;

Ref. 11 is the interconnection of a curved front surface of one pendant with a curved rear surface of an adjacent pendant; and Ref. 12 is the curved rear surface of a pendant.

DETAILED DESCRIPTION OF DRAWINGS

While the above description is of the preferred embodiment of the present invention, it should be appreciated that the invention may be modified, altered, or varied without deviating from the scope and fair meaning of the following claims.

Referring generally to FIGS. 1-4, the adjustable jewelry system consists of a bail clasp and a number of pendants which can be interchanged and arranged in endless combinations to create distinct variations using a single jewelry system. A jewelry wearer has the option of choosing from a variety of colors, shapes, and sizes to alter the look of the adjustable jewelry system. In this embodiment, the pendants are round, but they may be oblong, heart shaped, rectangular, or any other shape. However, the pendants may also be solid in other embodiments of the adjustable jewelry system. Regardless of whether the pendants have an opening, the pendants would still be stackable and complementary. Once a user determines the color, shape and size combinations of the desired look, the user would attach the desired pendants to the open pendant bail clasp. Once the desired look is achieved, the user would close the pendant bail clasp, thereby securing the chosen pendants about the pendant bail clasp.

Figure 1:
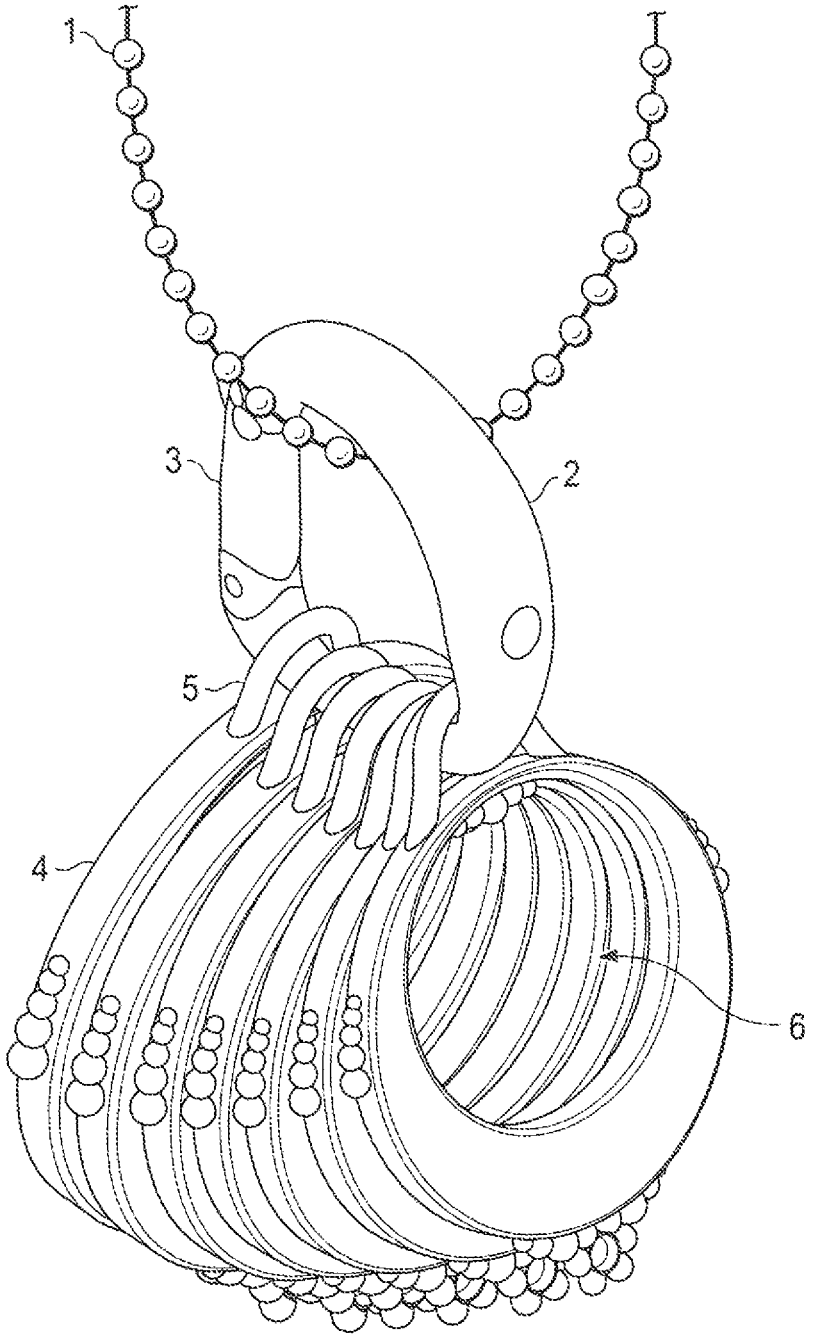
FIG. 1 is a perspective view of the adjustable jewelry system;
Ref. 1 is a chain;
Ref. 2 is the pendant bail clasp;
Ref. 3 is the pendant bail clasp latch;
Ref. 4 is a pendant;
Ref. 5 is a pendant top bad opening or jumping;
Ref. 6 is a pendant center opening.

FIG. 1 is a perspective view of the adjustable jewelry system. The adjustable jewelry system may hang from a variety of jewelry chains 1. In this embodiment, the pendants 4 are arranged in descending order according to pendant size; however the pendants 4 may be staggered without regard to size or arrangement. The pendants 4 may also be arranged in ascending order according to size. In order to create prepare the adjustable jewelry for wearing around the user's neck, the chain 1 is threaded through the open area of the pendant bail clasp 2 or the chain 1 may be inserted at the opening of an open pendant bail clasp 2. The pendant bail clasp 2 is a circular joint with a bail clasp latch 3 that allows the pendant bail clasp to be in an open or closed position at rest. In this embodiment, the pendant bail clasp 2 opens with a hinge system. Each pendant 4 or charm has a jumping or top opening 5 through which the pendant 4 or charm may be attached to the pendant bail clasp 2. The jumping 5 is a hook mechanism of the pendant 4 or charm. The pendants in this embodiment also include a center opening 6. The pendant bail clasp 2 with select pendants may be worn about the user's neck by hanging the pendant bail clasp from a jewelry chain.

Figure 2:
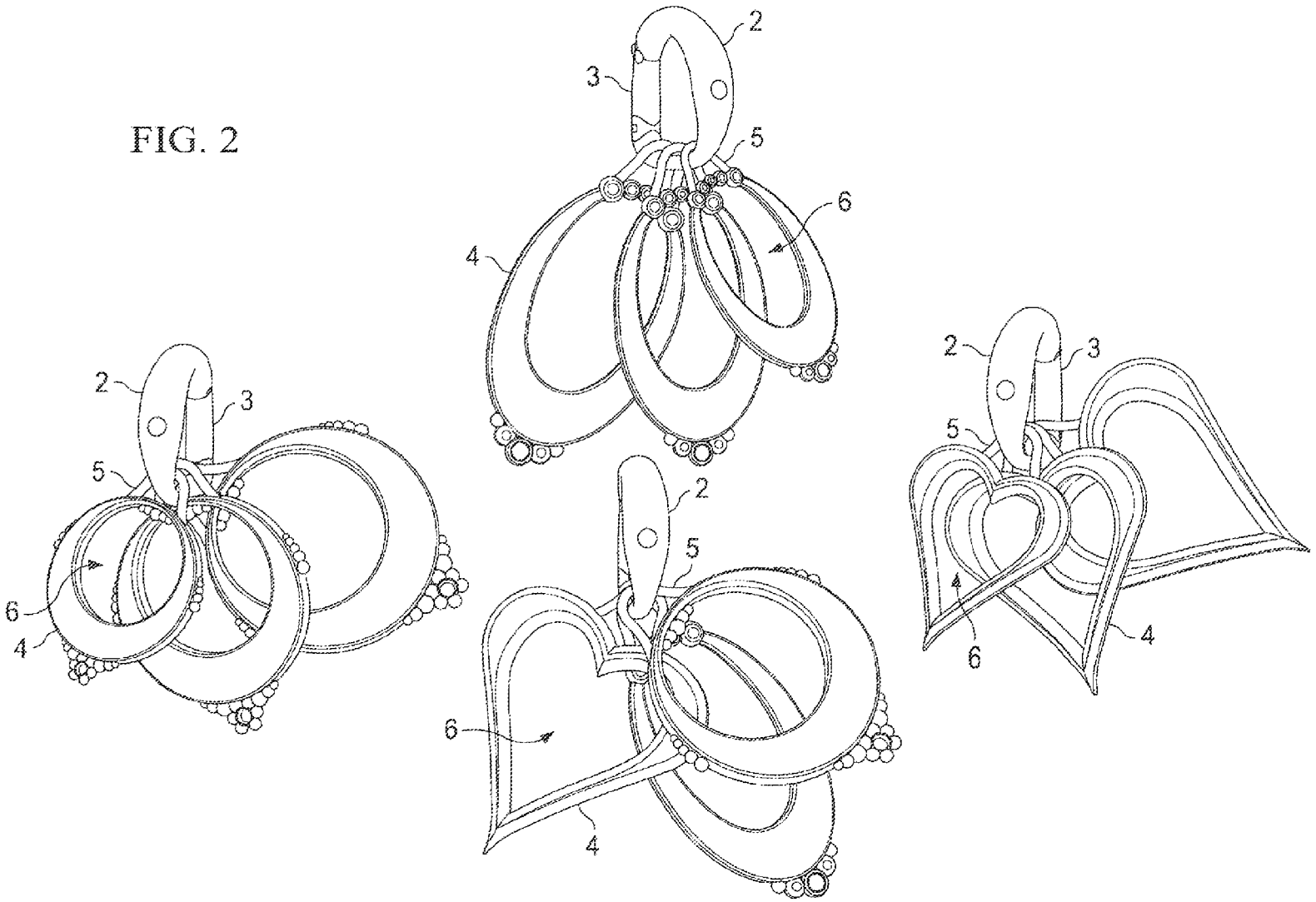
FIG. 2 is a close up view of several pendants;
Ref. 2 is the pendant bail clasp;
Ref. 3 is the pendant bail clasp latch;
Ref. 4 is a pendant;
Ref. 5 is a pendant top bail opening or jumping;
Ref. 6 is a pendant center opening.

FIG. 2 is close up view of a several pendants of varying sizes and shapes attached to the pendant bail clasp 2. Each pendant 4 or charm of the adjustable jewelry system also includes a top bail opening or jumping 5 that may be threaded onto the pendant bail clasp 2 to create the various looks of the adjustable jewelry system. In this embodiment, the pendants include a center opening 6 but the pendants may also be solid with a top bail opening. The user would open the pendant bail clasp 2 at the latch 3 section and hinge device. An assortment of pendants would be attached to the pendant bail clasp 2. Once the desired look is achieved, the pendant bail clasp 2 would be closed. Either the chain 1 may also be inserted through the open latch 3 or the chain may be threaded through the closed pendant bail clasp 2. The pendants 4 may be a variety of shapes such as oval, circular, rectangular, or heart shaped. Pendants of differing sizes, colors, and shapes may be combined to create a customized jewelry piece for the user. The number of pendants available to a user also determines the number of custom combinations said user may create.

Figure 3B:
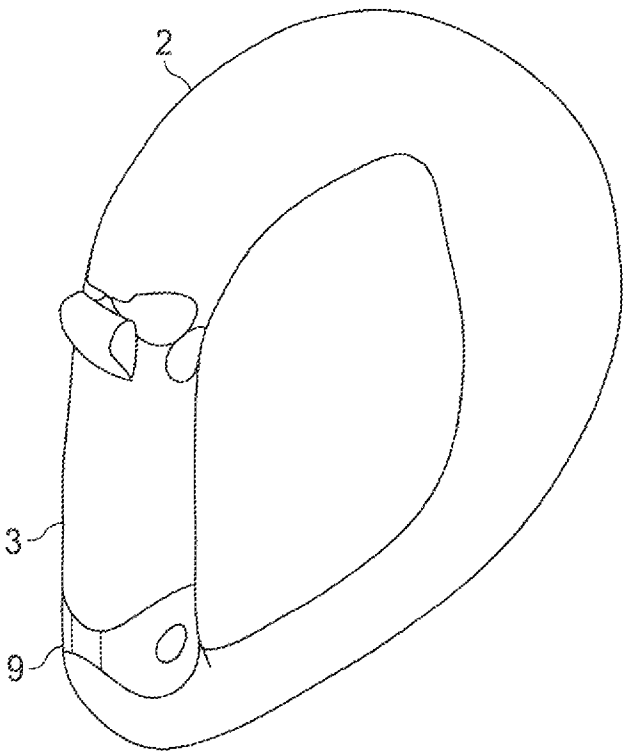
FIG. 3B is a close up view of the pendant bait clasp in a closed position;
Ref. 2 is the pendant bail clasp;
Ref. 3 is the pendant bail clasp latch;
Ref. 9 is the bail clasp hinge.
Figure 3A:
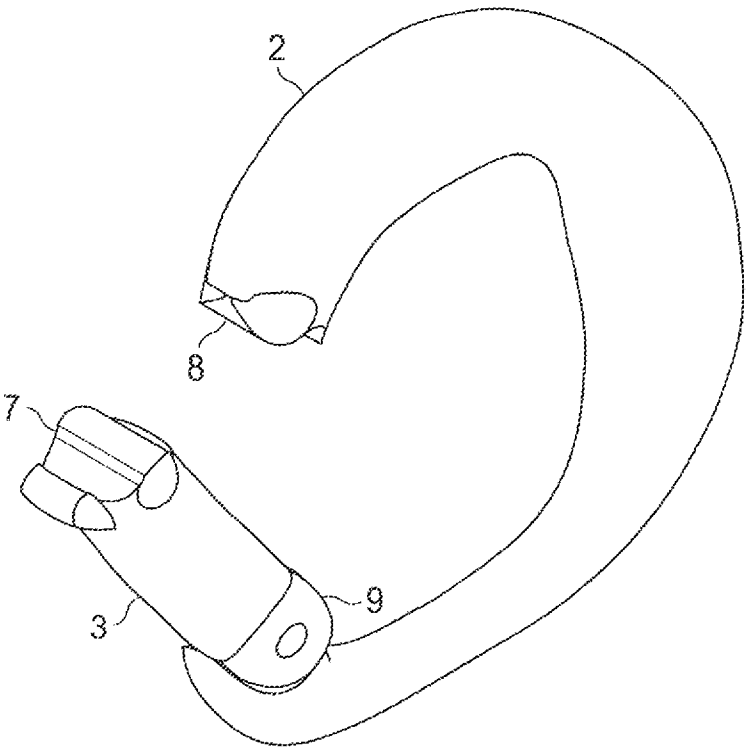
FIG. 3A is a close up view of the pendant bail clasp in an open position;
Ref. 2 is the pendant bail clasp;
Ref. 3 is the pendant bail clasp latch;
Ref. 7 is a beveled edge of the clasp latch;
Ref. 8 is a beveled edge of the bail clasp;
Ref. 9 is the bail clasp hinge.

FIG. 3A is a close up view of an open pendant bail clasp 2. In this embodiment, the pendant bail clasp 2 is a circular joint with a hinge closing mechanism. The opening of the pendant bail clasp 2 includes a hinge mechanism 9 on a first end and a beveled latch 3 on the opposite end. The hinge mechanism 9 allows the latch to be propped open while pendants are inserted or removed from the pendant bail clasp. The latch of the pendant bail clasp 3 includes a ridged or beveled top edge 7 which locks with a complementary beveled edge of the pendant bail clasp 8. In an open position, the beveled edges are separated.

FIG. 3B is a close up view of a closed pendant bail clasp. In this embodiment, the pendant bail clasp 2 is a circular joint with a spring hinge closing mechanism 9. The hinge mechanism 9 allows the latch 3 to be propped open while pendants 4 are inserted or removed from the pendant bail clasp 2. The latch of the pendant bail clasp includes a ridged or beveled top edge 7 which locks with a complementary beveled section of the pendant bail clasp 8. In a closed position, the beveled edges snap together to secure the pendant bail clasp in a closed position.

Figure 4:
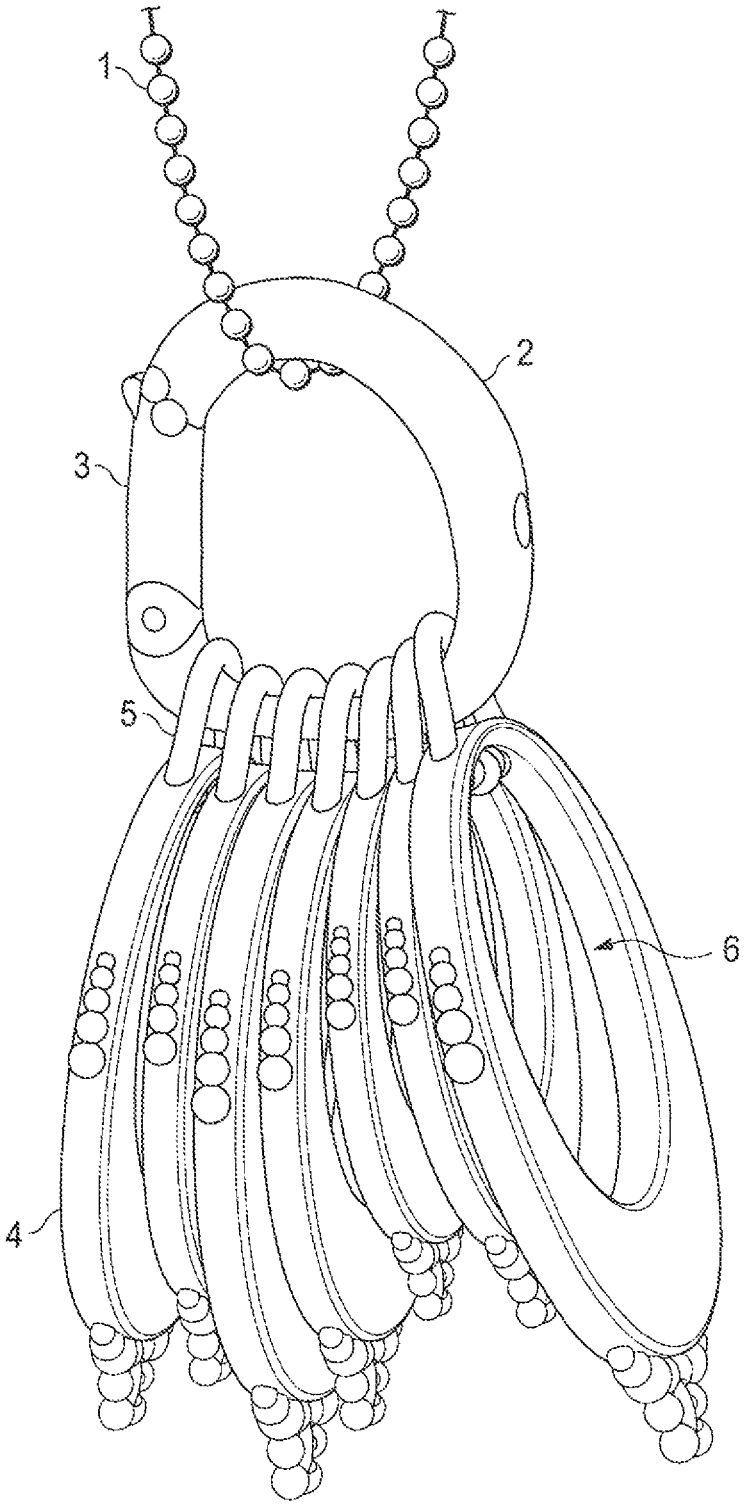
FIG. 4 is a perspective view of the adjustable jewelry system with varied pendants;
Ref. 1 is a chain;
Ref. 2 is the pendant bail clasp;
Ref. 3 is the pendant bail clasp latch;
Ref. 4 is a pendant;
Ref. 5 is a pendant top bail opening or jumping;
Ref. 6 is a pendant center opening.

FIG. 4 is a perspective view of a pendant bail clasp 2 with an assortment of pendants 4 stacked without regard to ascending or descending pendant or charm sizes. The present embodiment illustrates that an infinite combinations of pendants 4 and various looks may be created with a finite number of pendants. The chain 1 is threaded through the top opening of the pendant bail clasp 5 or the chain 1 may be inserted at the opening of an open pendant bail clasp 2. The pendant bail clasp 2 is a circular joint with a hinge 9 and a beveled edge 8. The hinge device allows the clasp latch 3 to be propped open while pendants are removed or inserted onto the pendant bail clasp 2. The beveled edge of the latch 7 helps secure the pendant bail clasp 2 in a closed position. Each pendant or charm has a top bail opening or jumping 5 through which the pendant 4 or charm may be attached to the pendant bail clasp 2. The pendants in this embodiment also include a center opening 6. Through the center opening 6, additional views may be created when the adjustable jewelry system is viewed from the front as well as the side since pendants will be visible behind and in front of other pendants. The pendant bail clasp 2 with select pendants may be worn about the user's neck by hanging the pendant bail clasp from a jewelry chain 1.

Figure 5:
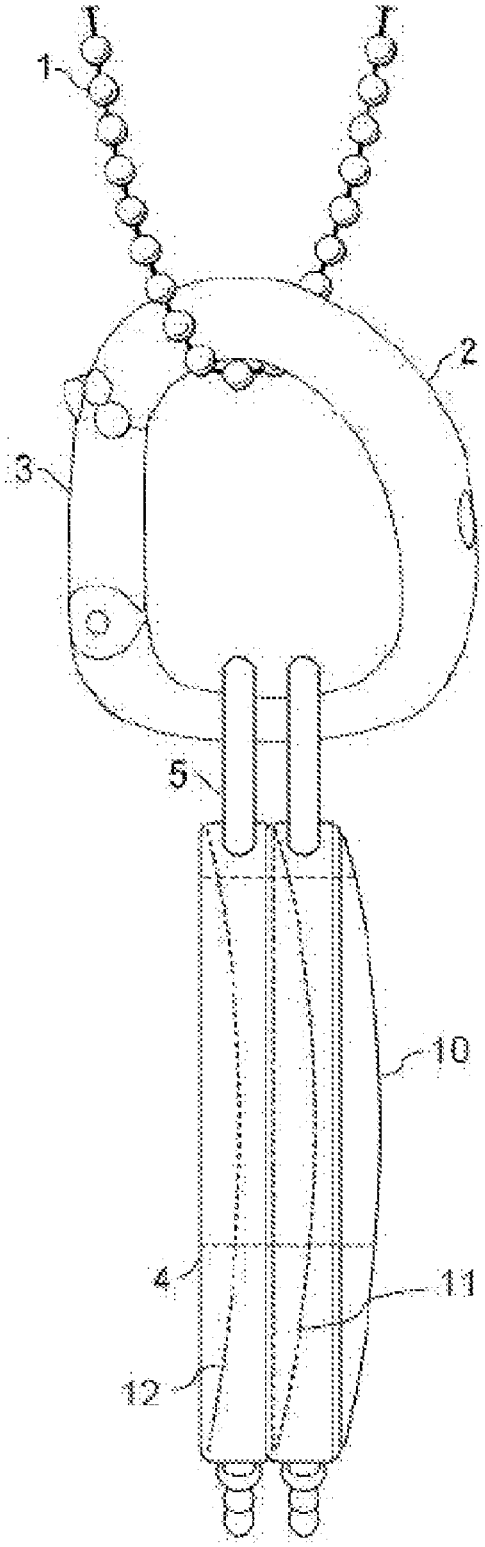
FIG. 5 is a side view of an adjustable jewelry system embodying the principles of the present invention;
Ref. 1 is a chain;
Ref. 2 is the pendant bail clasp;
Ref. 3 is the pendant bail clasp latch;
Ref. 4 is a pendant;
Ref. 5 is a pendant top bail opening or jumping;
Ref. 10 is a curved front surface of a pendant.

FIGS. 5 and 6 are respective side views of an adjustable jewelry system embodying the principles of the present invention, illustrating how the pendants 4 may interconnect 11 to accommodate for a vertically-stacked array. Specifically, FIG. 5 is a full side view of two annular pendants 4 of equal size while FIG. 6 is a cut, cross-sectional side view of four annular pendants 4 of various sizes. Each pendant may feature a curved front surface 10 and a corresponding curved rear surface 12 which allows any pendant to be the first, middle, or last in a series of pendants. Specifically, and in accordance with an embodiment of the present invention, the curve on the front surface 10 of each pendant 4 features the corresponding subtended angle of the curve on the rear surface 12 of each pendant so the front surface of any ornament may interconnect 11 and nest with the rear surface of any other ornament in a series of ornaments. Although he curves have been enlarged to show detail, the curves on each surface of an ornament may be subtle in accordance with an embodiment of the present invention.

What is claimed is:

1. A vertically stackable jewelry system consisting of:

a hinged clasp with an opening lever;

a series of removeable ornaments positioned inside said clasp;

each of said ornaments comprising a curved front surface configured to interconnect and engage with a curved back surface of another ornament;

and a hooking mechanism positioned at an exterior edge of said ornament.

2. The jewelry system of claim 1, wherein said hinged clasp includes a first end and a second end.

3. The jewelry system of claim 2, wherein said opening lever includes a first end and a second end.

4. The jewelry system of claim 3, wherein said first end of said opening lever is adjacent to said first end of said hinged clasp, wherein said second end of said opening lever is adjacent to said second end of said hinged clasp, when said hinged clasp is in a closed position.

5. The jewelry system of claim 1, wherein said hooking mechanism is permanently attached to an exterior edge of each of said ornaments.

6. The jewelry system of claim 5, wherein said hooking mechanism is uniform in dimension for said series of ornaments to further facilitate vertical stacking of said series of ornaments.

7. The jewelry system of claim 1, wherein said back surface of each of said ornaments is curved to facilitate stacking of said front surface of each of said ornaments upon said rear surface of each of said ornaments inside said hinged clasp.

8. The jewelry system of claim 7, wherein said front surface of each of said ornaments is curved to facilitate stacking of said rear surface of each of said ornaments with said front surface of each of said ornaments inside said clasp.

9. A method comprising:

opening a lever on a hinged clasp;

attaching a hooking mechanism of a first ornament with a curved front surface and curved back surface along said hinged clasp;

attaching a hooking mechanism of a second ornament with a curved front surface and curved back surface along said hinged clasp;

wherein the curved back surface of said second ornament is interconnected and engaged with said front surface of said first ornament;

attaching a hooking mechanism of a third ornament with a curved front surface and curved back surface along said hinged clasp;

wherein the curved back surface of said third ornament is interconnected and engaged with said curved front surface of said second ornament;

repeating the attachment of a series of ornaments until the desired number of ornaments are interconnected along said hinged clasp; and closing a lever on said hinged clasp to secure said series of ornaments along said hinged clasp.

10. The jewelry system of claim 9, wherein said series of ornaments may be any combination of sizes of ornaments, wherein said series of ornaments may be any combination of shapes of ornaments.

* * * * *